US005335602A

United States Patent [19]

Richter et al.

[11] Patent Number: 5,335,602

[45] Date of Patent: Aug. 9, 1994

[54] BOGIES FOR RAIL VEHICLES

[75] Inventors: Wolfgang-Dieter Richter, Nuremberg; Ulrich Hachmann, Pyrbaum; Peter Frahm, München, all of Fed. Rep. of Germany

[73] Assignee: Man GHH Schienenverkehrstechnik GmbH, Nuremberg, Fed. Rep. of Germany

[21] Appl. No.: 71,180

[22] Filed: Jun. 2, 1993

Related U.S. Application Data

[63] Continuation of Ser. No. 842,052, Feb. 26, 1992, abandoned.

[30] Foreign Application Priority Data

Feb. 27, 1991 [DE] Fed. Rep. of Germany ..... 4106070

[51] Int. Cl.[5] ..... B61F 5/00

[52] U.S. Cl. ..... 105/168; 105/199.1; 105/182.1

[58] Field of Search ..... 105/133, 136, 138, 168, 105/199.1, 165, 167, 174, 182.1

[56] References Cited

U.S. PATENT DOCUMENTS

| | | | |
|---|---|---|---|
| 3,628,465 | 12/1971 | Dobson et al. | 105/199.1 |
| 3,841,232 | 10/1974 | Hess | 105/199.1 |
| 4,015,541 | 4/1977 | Roosen | 105/199.1 |
| 4,173,933 | 11/1979 | Kayserling | 105/182.1 |
| 4,337,706 | 7/1982 | Loosli | 105/184 |
| 4,411,202 | 10/1983 | Kreissig | 105/199.1 |
| 5,031,545 | 7/1991 | Bourgeot | 105/199.1 |

FOREIGN PATENT DOCUMENTS

| | | | |
|---|---|---|---|
| 0420801 | 3/1991 | European Pat. Off. | 105/199.1 |
| 0256510 | 8/1964 | Netherlands | 105/199.1 |
| 0118675 | 7/1930 | Switzerland | 105/199.1 |
| 0416716 | 1/1967 | Switzerland | 105/199.1 |
| 0187073 | 10/1966 | U.S.S.R. | 105/199.1 |

*Primary Examiner*—Mark T. Le
*Attorney, Agent, or Firm*—Harold L. Burstyn

[57] ABSTRACT

In a bogie for rail vehicles, in particular a driven bogie, with a bogie frame, two or more wheelset units which may comprise at least one drive unit and/or brake unit, connected with the bogie frame via a primary suspension, and a secondary suspension for connecting a vehicle body with the bogie frame, a rigid connecting link extends from at least one of the wheelset units for connecting the bogie to the vehicle body. The rigid connecting link is coupled to the wheelset unit at its inertial pole or center of mass.

7 Claims, 7 Drawing Sheets

Fig 2
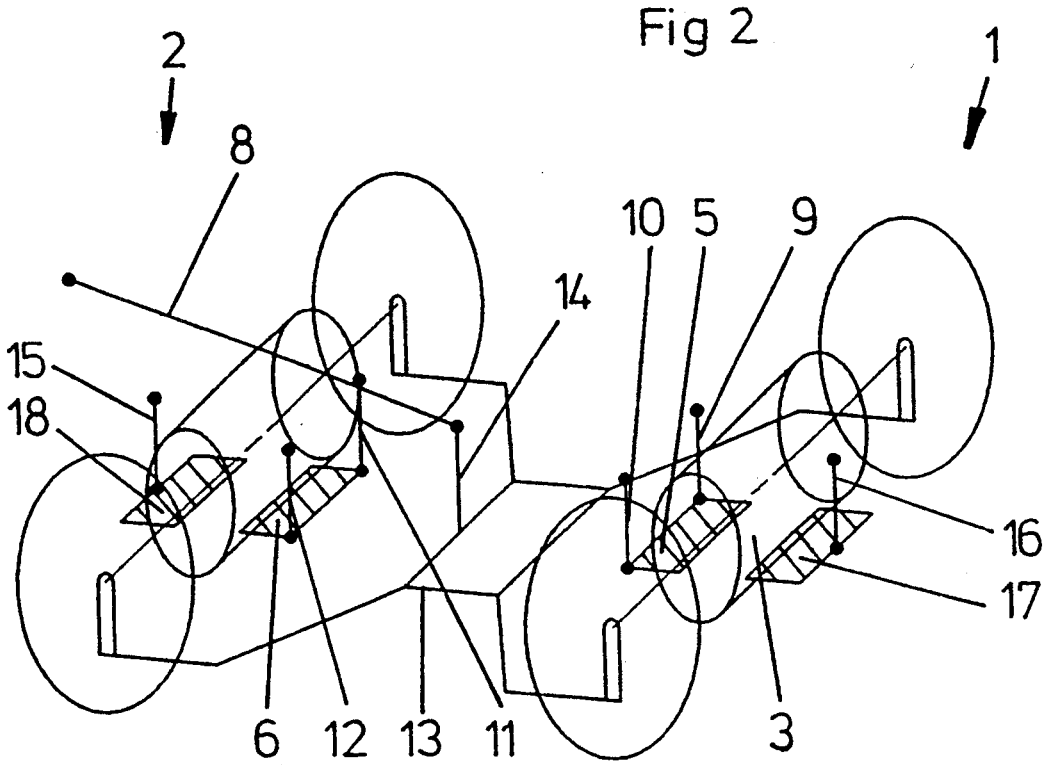
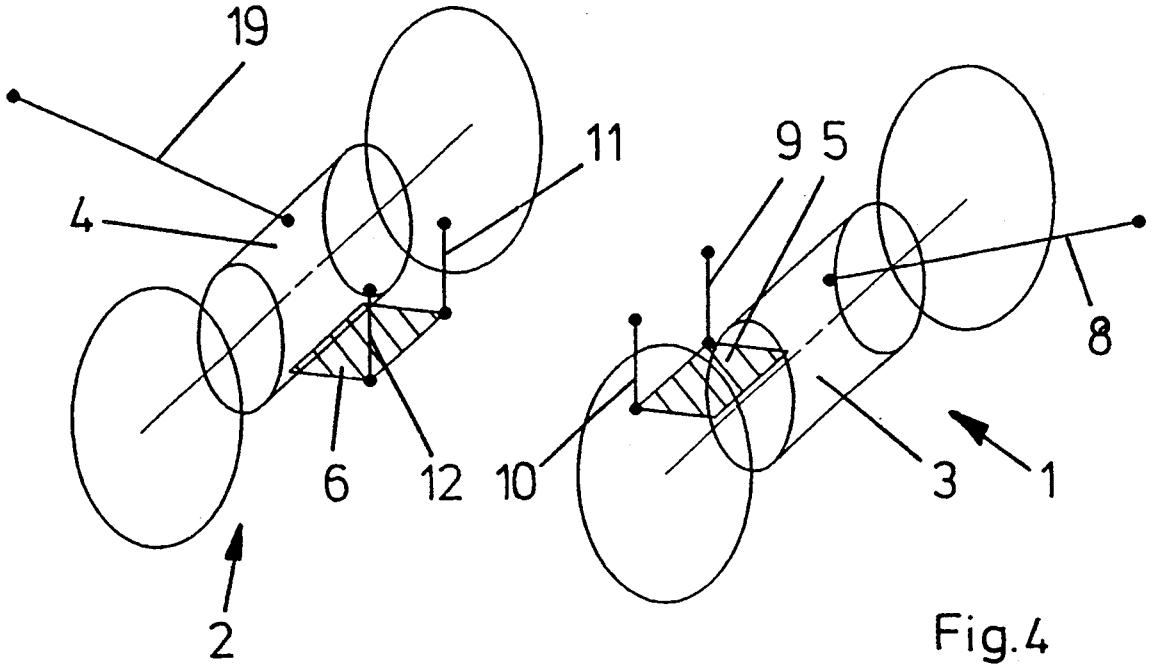
Fig.4

BOGIES FOR RAIL VEHICLES

This application is a continuation of Ser. No. 07/842,052 filed Feb. 26, 1992, now abandoned.

FIELD OF THE INVENTION

The invention relates to bogies for rail vehicles.

BACKGROUND

The invention is especially applicable to driven bogies which comprise a bogie frame, typically comprising longitudinal and lateral beams; two or more wheelset units, which may include a drive unit and/or brake unit, connected with the bogie frame via a primary suspension, or a linkage and a primary suspension; and a secondary suspension, or a center pin or similar device and a secondary suspension, for connecting the bogie frame to a car body.

For such bogies, it is desirable that the wheelsets, depending on the longitudinal stiffness of the primary wheelset linkage or suspension, can adjust themselves in a curved track. A large number of such bogies with radially adjustable wheelsets have been disclosed. With the majority of these bogies, as disclosed, for example, in German patent specifications DE 31 19 164 C2 and DE 32 32 289 A1 and WIPO patent specification WO 90/02068 which are incorporated herein by reference, more or less rigidly linked coupling mechanisms are used, arranged between the wheelsets, or between the wheelsets and the car body. Also known is the mechanical coupling of a wheelset with a drive unit, which—by the arrangement of the coupling elements—allows the wheelset to swivel about an ideal or real pivoting point situated before or behind the wheelset in the direction of travel. Also, indirect mutual support of axle drives in conjunction with wheelset coupling elements is disclosed in European patent application 0 072 535 A1, incorporated herein by reference.

Because they involve many components, these known bogies are costly to assemble and to maintain, and they involve close tolerances.

Some bogies allow more or less free adjustment of the wheelsets due to very low rates of longitudinal stiffness in their primary linkage. However, since the primary linkage must also transfer the tractional forces during starting and braking, the forces adjusting the wheelset are interfered with or compensated for. The resulting parallel displacement of the wheelset must be limited because of the inherent geometry of the drive and the brake. This also results in limiting of the mutually opposite longitudinal travels of the primary linkage required for wheelset adjustment.

When wheelsets are driven by drive motors or power takeoffs suspended from the car body, via a drive shaft and axle drive, a turn-out movement of the bogie requires the drive shaft, which is arranged between the vehicle body and the bogie, to change its length (EP 0 072 535).

When drive momentum is transferred during passage over an inward or outward curve, a change in length requires extension forces, which can increase the turn-out resistance of the bogie several fold, and which—especially at high rates of drive performance—hamper or make impossible the free adjustment of the bogie to the curve.

It is therefore an object of the present invention to eliminate or at least mitigate the foregoing deficiencies and create an improved bogie, and in particular a traction bogie.

According to the present invention there is provided a bogie, for rail vehicles, comprising a bogie frame, two or more wheelset units, at least one of the wheel set units comprising least one of a drive unit, brake unit and wheelset coupling frame connected thereto, a primary suspension connecting the wheelset units to the bogie frame, a secondary suspension for connecting a vehicle body to the bogie frame, and a rigid guide rod for coupling between the bogie and a vehicle body, the guide rod being coupled at its one end to said one of said wheelset units at or as close as possible to an inertial pole thereof.

Such coupling at, or as close as possible to the inertial pole of the wheelset or drive unit, or at the vertical axis of the mass moment of inertia, tends to, avoid the occurrence of parasitic moments when traction forces are applied in curves, which would lead to a maladjustment of the wheelset. If the guide rod acts at a point located outwardly thereof, a parasitic moment develops when the bogie turns outward and at the same time traction forces occur, and this leads to maladjustment of the wheelset in the track.

Advantageously, in embodiments of the invention, the transmission of the traction forces is such that the wheelsets are allowed only a certain adjustment behavior determined by the forces of the wheel/track geometry, and the bogie frame is left to perform only "carrying" and "guiding" functions. An advantage of bogies embodying the invention is that they are easy to assemble and service, and do not require the highest of tolerances.

It is advantageous to have the guide rod flexibly mounted in non-wearing elastomeric elements capable of withstanding cardanic stress i.e., stress from any direction so that the longitudinal forces can be transferred without being controlled.

In the case of non-driven wheelsets, coupling can be established via a centrally arranged bearing or via a bifurcated shaft coupled to the wheelset bearings. In the case of driven wheelsets, the guide rod can be coupled close to the center of gravity of a drive unit elastically or rigidly connected with the wheelset.

Coupling of the wheelsets can be established individually or in such a way that both wheelsets are coupled with each other inside the bogie, and a common coupling is made via the guide rod to the vehicle body. In this case, two wheelsets, for example, can be coupled in such a way that the adjustment behaviour of the individual wheelsets is not affected, or a specific radial adjustment of both wheelsets, e.g., via a common central linkage point, can be achieved.

Embodiments of the invention make it possible to neutralize the traction moments that occur during starting or braking, especially when axle suspension motors or drives elastically supported on both sides of the wheel or on the wheelset shaft are used. To ensure that the turning movements of the wheelsets are not interfered with by the rigidly or transversely elastically mounted drive or brake units, the latter are advantageously suspended from the main cross beam of the bogie via pendulums.

A sufficiently soft design of the lateral characteristic of the common coupling and of the primary wheelset linkage allows the wheelsets to evade lateral disturbances individually, without transferring these to a considerable degree between both wheelsets.

If the arrangement of a single central coupling point in conjunction with the longitudinal stiffness of the linkage at the wheelset bearing is not enough to achieve a higher speed through stable travel, it can be replaced by paired coupling points or elements that can slide outwardly at random. The maximum speed can be further increased according to the invention by combining a coupling frame which connects all wheelset bearings at defined rates of elasticity, and which facilitates the use of fully elastic quill drives.

In the case of vehicles driven by a drive shaft and an axle drive, the coupling is arranged parallel to the drive shaft, with the guide rod having the same length as the drive shaft between the universal joint centers. This eliminates any change in length during outward-turning of the bogie. It is practical to integrate the momental support required at the axle drive into a bifurcated guide rod; the guide rod connecting two adjacent axle drives may be designed in a similar fashion.

BRIEF DESCRIPTION OF DRAWINGS

Embodiments of the invention will now be described by way of example only with reference to the accompanying drawings, in which:

FIG. 2, which follows

FIG. 3 is a schematic view of another embodiment of a bogie in which a guide rod is coupled to one of two wheelsets;

FIG. 4 is a schematic view of a bogie in which guide rods are coupled to respective ones of two wheelsets;

FIG. 7 is a schematic view of another embodiment of a bogie, in which a guide rod is arranged between a console and a striker arm connected with a center pin;

DESCRIPTION OF PREFERRED EMBODIMENTS

Figure 1:
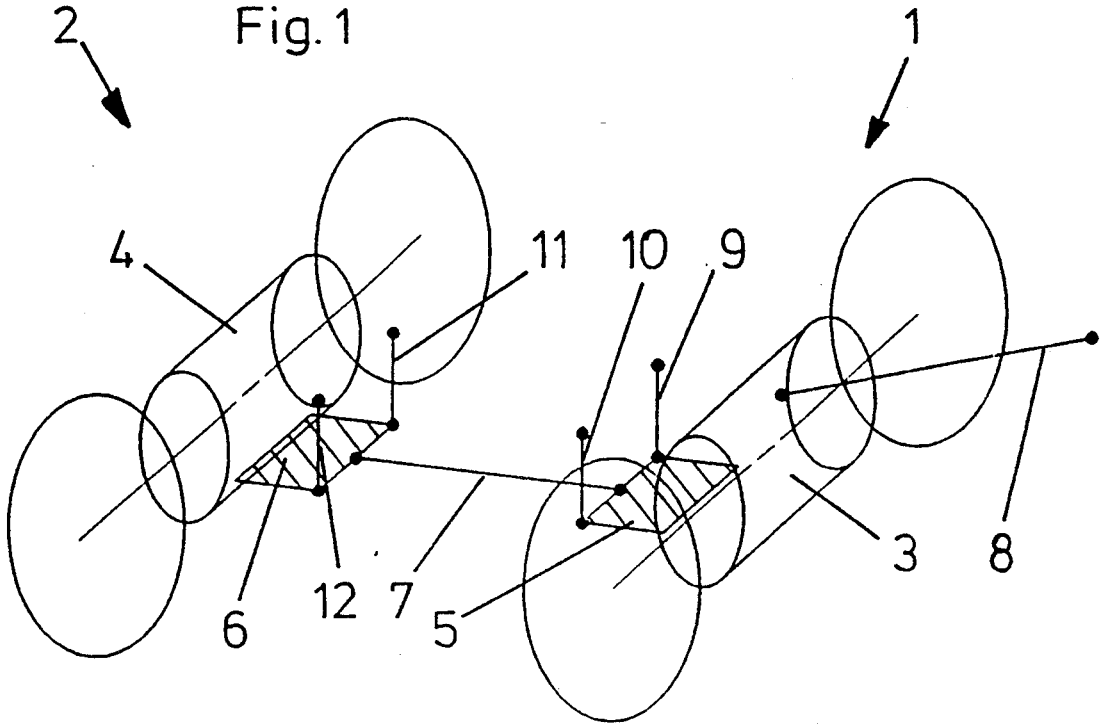
FIG. 1 is a schematic view of a bogie in which a guide rod is coupled to one of two wheelsets.

A bogie embodying the invention and illustrated schematically in FIG. 1 comprises two wheelsets 1 and 2, with respective drive units 3 and 4 which are connected with same and connected with each other via respective inward facing, i.e., mutually opposed, consoles 5 and 6 and a rigid connecting rod 7 for transferring the tractional forces. A guide rod 8 is arranged between drive unit 3 and the vehicle body (not shown). For stabilization, the drive units 3 and 4 are suspended on pendulums 9, 10, 11, 12 linked to the consoles 5 and 6 and the bogie frame (not shown). All linkages are cardanic. The drive units shown here in schematic view can also be brake units or combinations of both.

FIG. 2 shows a bogie with a coupling frame 13, which connects the wheelset bearings of the two wheelsets 1 and 2. The drive units 3 and 4 are provided not only with inward facing consoles 5 and 6, but also with outward-facing consoles 17 and 18, respectively, and they are connected with the bogie frame (not shown) not only via the pendulums 9, 10, 11, 12 linked to the inner consoles, but also via pendulums 15 and 16 linked to the outer consoles. In the region where the connections of the individual wheelset bearings converge, the coupling frame 13 is provided with an upright link rod 14, to which the guide rod 8, whose other end is connected with the vehicle body (not shown), is linked.

Figure 3:
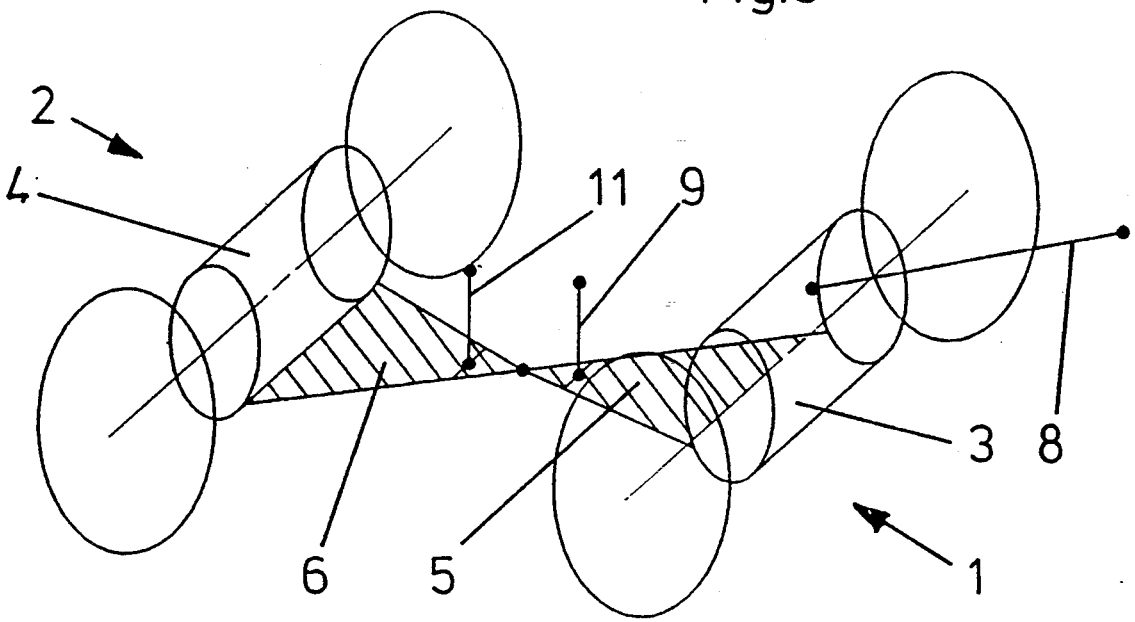
FIG. 3, is a schematic view of a bogie in which a guide rod is coupled to a coupling frame uniting all wheelset bearings.

The embodiment according to FIG. 3 shows two wheelsets 1 and 2, with drive units 3 and 4 and inward facing consoles 5 and 6. Here consoles 5 and 6 are linked directly to each other so that no connecting rod is necessary to transfer the tractional forces. In this embodiment, only two pendulums 9 and 11 are provided between the consoles 5 and 6, respectively, and the bogie frame (not shown). The guide rod is arranged between the drive unit 3 of the wheelset 1 and the vehicle body (not shown).

FIG. 4 shows an embodiment with two separate linkages. The two wheelsets 1 and 2 with respective drive units 3 and 4 and inward facing consoles 5 and 6 and pendulums 9, 10 and 11, 12 between these consoles 5 and 6 and the bogie frame (not shown) are not connected with each other. Since, in this case, transmission of the tractional forces between wheelsets 1 and 2 is not possible, guide rods 8 and 19 connect drive units 3 and 4, respectively, with the vehicle body (not shown). In the case of bogies in which only one wheelset is provided with a drive or brake unit, there would be—as in this case—no connection between the two wheelsets and the guide rod on the non-driven or non-braked wheelset.

Figure 5:
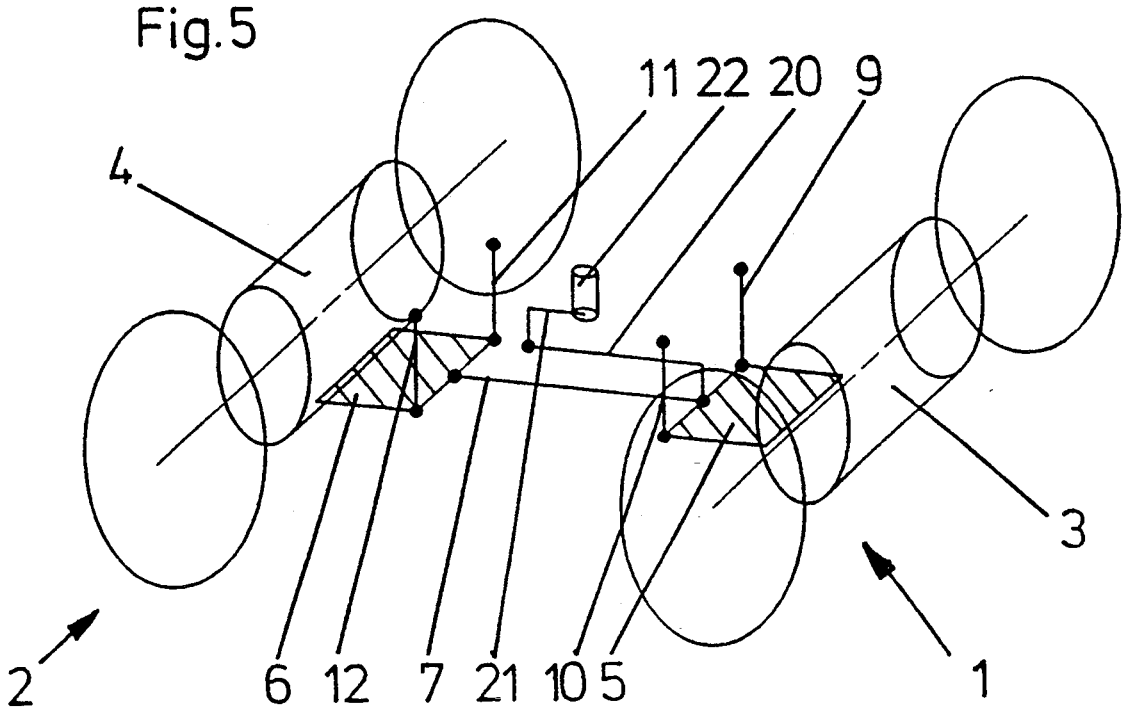
FIG. 5 is a schematic view of a bogie in which the guide rod is coupled between a console and a striker arm connected with a center pin.

FIG. 5 shows another embodiment of the invention. The bogie of FIG. 5 has two wheelsets 1 and 2 provided with drive units 3 and 4, respectively, and with inward facing consoles 5 and 6, to which, as described, pendulums 9, 10, 11, 12 are linked and connected with the bogie frame (not shown). The two consoles 5 and 6 are connected with each other via a connecting rod 7. A guide rod 20 is coupled at one end to the console 5 of wheelset 1, and at the other end to a striker arm 21, which is connected to a center pin 22 of the vehicle body.

Figure 6:
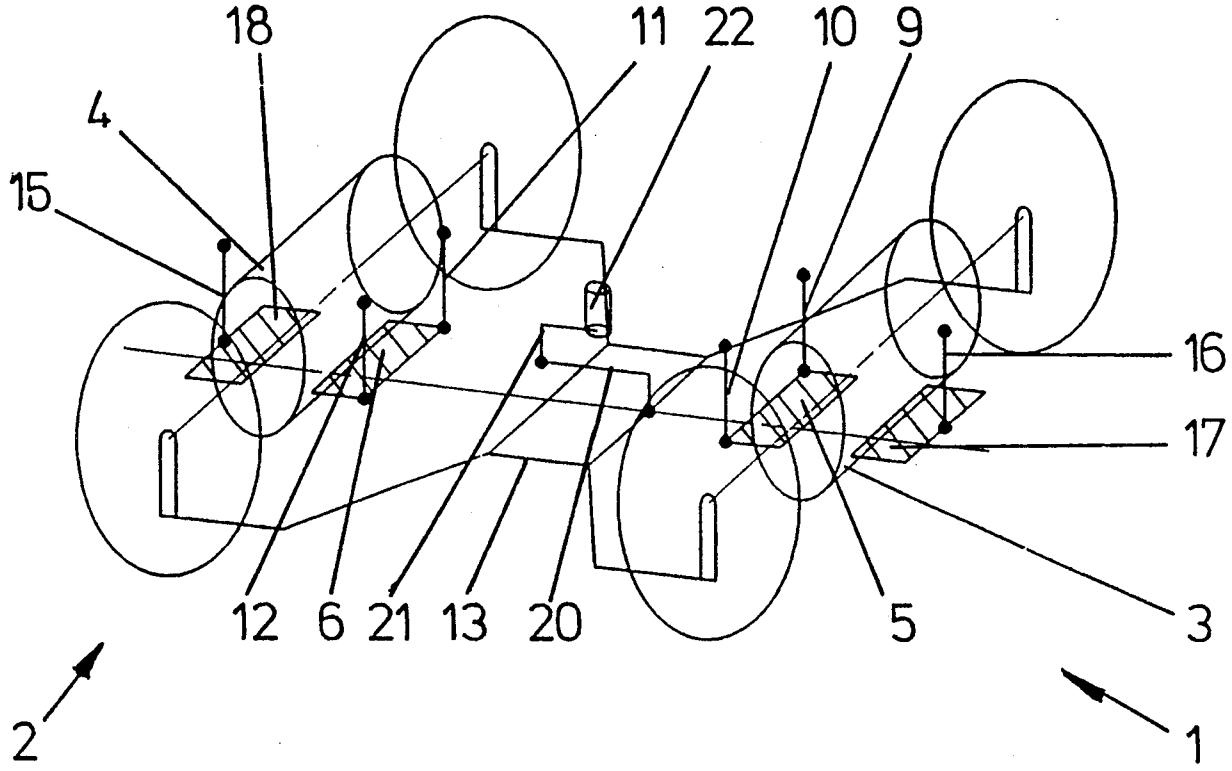
FIG. 6, which follows

FIG. 6 shows another embodiment of a bogie. Here the bogie is provided with a coupling frame 13, consoles 5, 6, 17 and 18 and pendulums 9, 10, 11 and 12, as described above for FIG. 2.

The guide rod 20 is linked in the region of the coupling frame 13, in which the connections to the individual wheelset bearings converge. At its other end, the guide rod 20 is linked to a striker arm 21 connected with the center pin 22 of the vehicle body.

Figure 7:
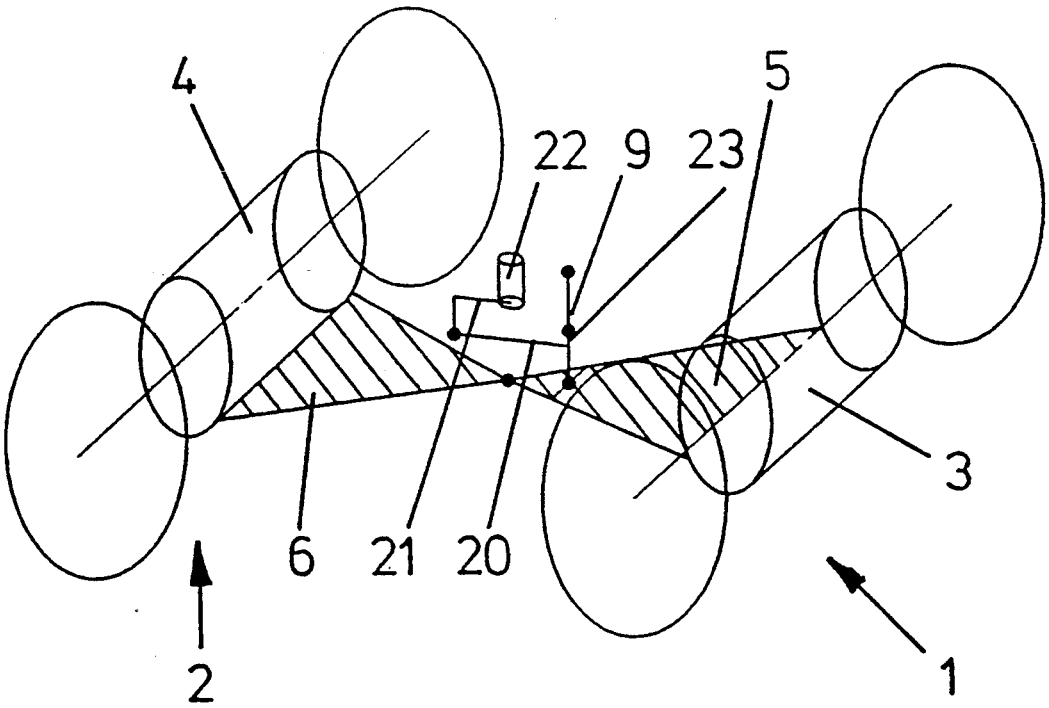
FIG. 7, is a schematic view of a bogie with a coupling frame, in which a guide rod is coupled between the coupling frame and a striker arm connected with a center pin.

FIG. 7 shows a bogie with two wheelsets 1 and 2, with drive units 3 and 4 connected with each other by their inward facing consoles 5 and 6, respectively. Here the guide rod 20 is linked to a console 5, and at its other side with the striker arm 21 for engaging the center pin 22 of the vehicle body. In this case, the suspension of the drive units 3 and 4 is accomplished via a single pendulum 9 that is arranged between an upright extension 23 of the guide rod 20 and the bogie frame (not shown).

Figure 8:
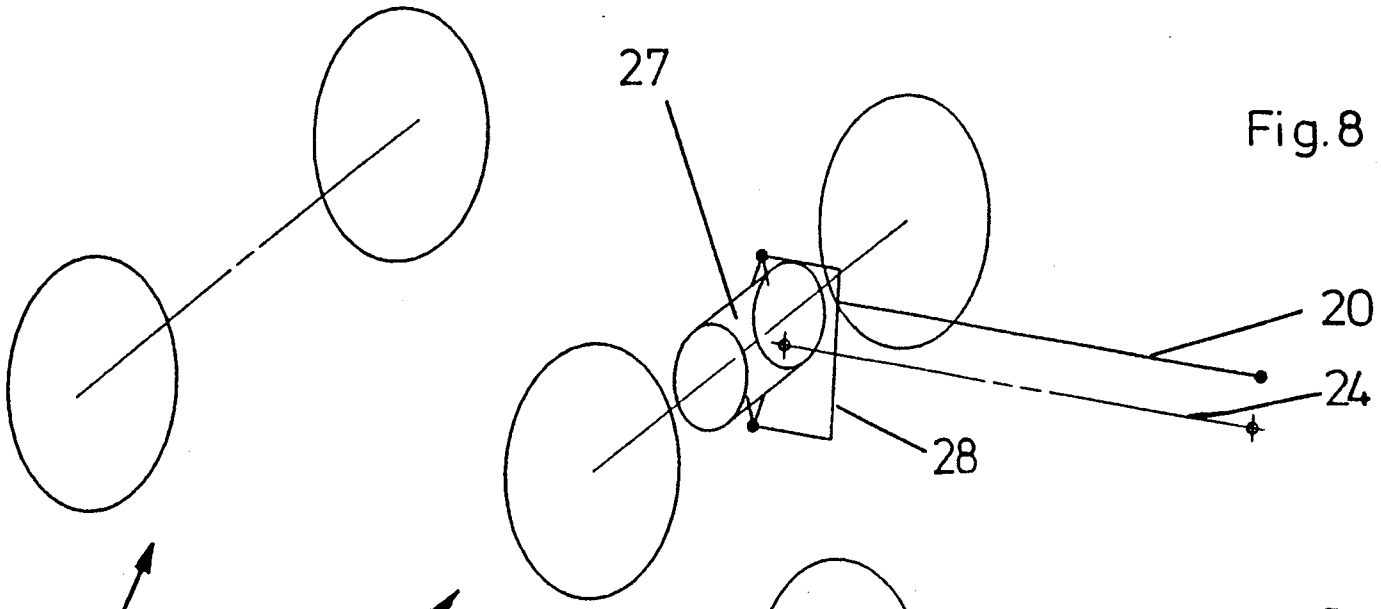
FIG. 8 is a schematic view of another embodiment of a bogie with a drive via a drive-shaft and with a guide rod coupled to one wheelset.

FIG. 8 shows a bogie comprising two wheelsets 1 and 2, wherein one wheelset 1 is driven by a drive shaft 24 and an axle drive 27. The guide rod 20 is linked to the driven wheelset 1 and extends substantially parallel to the drive shaft 24. The axle drive 27 is embraced castor-fashion above and below by a bifurcated extension 28 of the guide rod 20, whereby the guide rod 20 is linked above and below to the axle drive 27, thus integrating the torque support for the axle drive 27. At its other end, the guide rod 20 is linked to the vehicle body (not shown).

Figure 9:
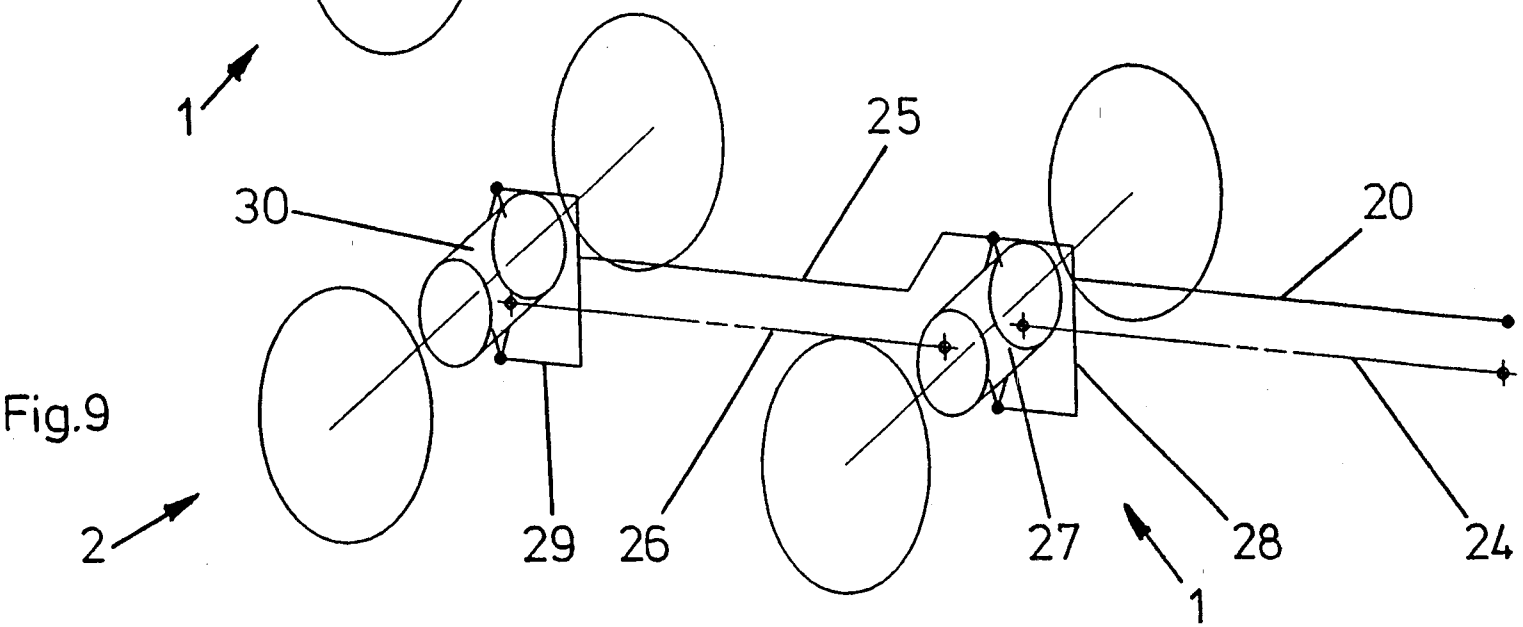
FIG. 9 is a schematic view of a bogie with a drive via drive shafts to two wheelsets and with a guide rod coupled to one wheelset.

FIG. 9 shows a bogie as in FIG. 8, with the difference that the second wheelset 2 is also driven, via a second drive shaft 26, which is arranged between the axle drive 27 of wheelset i and an axle drive 30 of the second wheelset. The guide rod 20 is connected with the axle drive 27 of the first wheelset 1 as illustrated in FIG. 8. A connecting rod 25 extends between the axle drive 27 of the first wheelset i and the axle drive 30 of the second wheelset 2, to transfer the tractional forces. A bifurcated extension 29 of connecting rod 25 embraces the second axle drive 30 in like manner to that illustrated in FIG. 8 with the guide rod 23.

Figure 10:
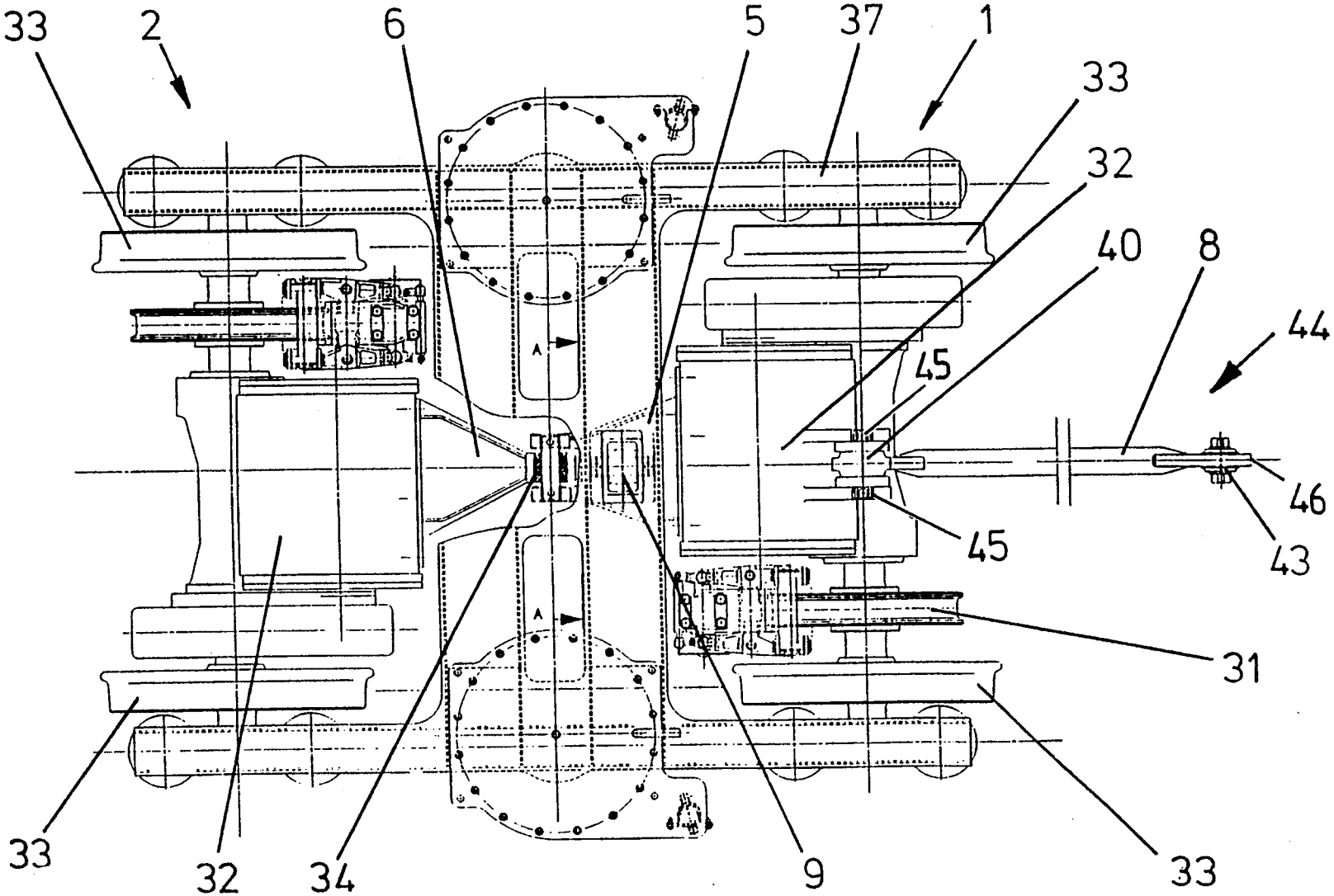
FIG. 10 is a top view of the embodiment of a bogie according to FIG. 3.
Figure 11:
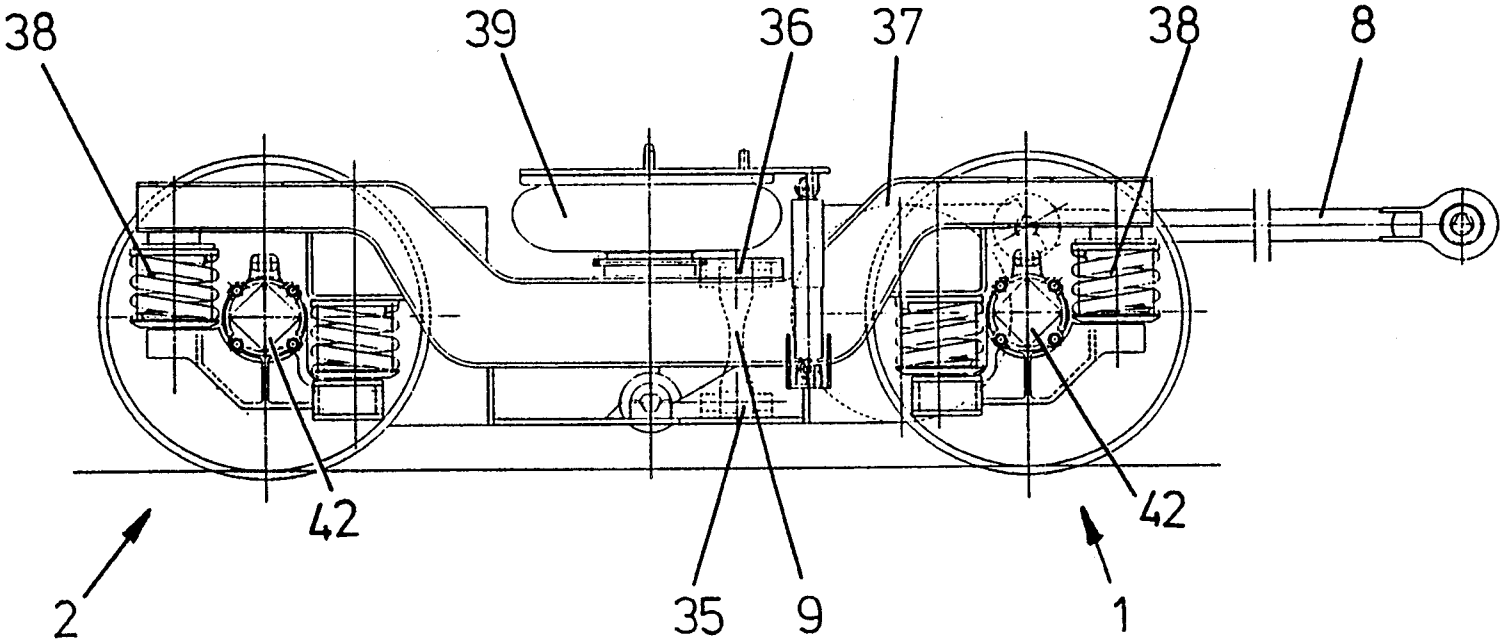
FIG. 11 is a lateral view of the bogie according to FIG. 10.

FIGS. 10 and 11 show the embodiment of a bogie according to the schematic view in FIG. 3, but with only one pendulum 9 provided. The bogie has two wheelsets 1 and 2, each with wheels 33, and the wheelsets are connected with the bogie frame 37 via wheelset bearings 42 and primary springs 38. Also arranged between the bogie frame 37 and the vehicle body 44 are secondary springs 39. Both wheelsets 1 and 2 are provided with drive units, namely axle-mounted motors 32, and brake units 31. On their housings, the axle-mounted motors 32 are provided with consoles 5 and 6, respectively, (facing toward the middle of the bogie), which are connected with each other via a cardanic coupling 34. Console 5 is provided with a cardanic linkage 35 in which a pendulum 9 is linked. At its other end, the pendulum 9 is linked to the bogie frame, again via a cardanic linkage 36. Finally, the guide rod 8 is connected at its one end to the axle-mounted motor 32 of the first wheelset 1 via a cardanic joint 40 and at its other end to the vehicle body 44 via a cardanic joint 43. That is how tractional forces which occur are transferred directly to the vehicle body by the wheelsets via the consoles 5 and 6 (connecting the wheelsets with each other) or via the guide rod 8. This allows the adjusting behaviour of the wheelsets to be determined solely by the forces of the wheel/track geometry, while the bogie frame has nothing but "carrying" and "guiding" functions.

We claim:

1. A bogie for rail vehicles, comprising:
a bogie frame;
at least two wheelset units;
at least one of said wheelset units including at least one of a drive unit, a brake unit, and a wheelset coupling frame connected to said at least one of said wheelset units;
a primary suspension connecting said at least two wheelset units to said bogie frame;
a secondary suspension for connecting a vehicle body to said bogie frame;
a rigid guide rod interconnecting said bogie and said vehicle body;
said guide rod extending longitudinally of said vehicle;
said guide rod having a first end and a second end;
said guide rod having a coupling means at said first end;
said coupling means being connected to said at least one of said wheelset units;
said coupling means having a horizontal pivotal axis;
said at least one of said wheelset units including a wheel axle interconnecting a pair of wheels;
said wheel axle having a longitudinal axis;
said horizontal pivotal axis extending parallel to said longitudinal axis;
said coupling means being mounted directly on said at least one of said wheelset units and at the center of mass of said at least one of said wheelset units; and
said guide rod extending outwardly from said bogie frame and being connected at said second end to said vehicle body.

2. A bogie according to claim 1, wherein said guide rod is connected at said second end by means of a cardanic joint.

3. A bogie according to claim 1, wherein said wheelset units include respective consoles extending substantially horizontally toward a center of said bogie.

4. A bogie according to claim 3, further comprising means for interconnecting said consoles.

5. A bogie according to claim 4, wherein said means for interconnecting comprises at least one cardanic coupling.

6. A bogie according to claim 4 wherein said wheelset units include drive units connected to respective wheelset units and said consoles extend from said drive units.

7. A bogie according to claim 4 wherein at least one pendulum extends between said means for interconnecting and said bogie frame.

* * * * *